US009115557B1

(12) United States Patent
Ortowski et al.

(10) Patent No.: US 9,115,557 B1
(45) Date of Patent: Aug. 25, 2015

(54) DUST COLLECTION SYSTEM

(71) Applicant: Orteq Energy Technologies, LLC, Gainesville, TX (US)

(72) Inventors: Ronald Ortowski, Gainesville, TX (US); Patrick McGuire, Trophy Club, TX (US)

(73) Assignee: ORTEQ ENERGY TECHNOLOGIES, LLC, Gainesville, TX (US)

( * ) Notice: Subject to any disclaimer, the term of this patent is extended or adjusted under 35 U.S.C. 154(b) by 38 days.

(21) Appl. No.: 14/094,874

(22) Filed: Dec. 3, 2013

(51) Int. Cl.
*E21B 21/07* (2006.01)

(52) U.S. Cl.
CPC ..... *E21B 21/07* (2013.01)

(58) Field of Classification Search
CPC ..... B01D 29/00; B01D 29/50; C02F 1/00; E21B 27/00; E21B 43/267
USPC ..... 210/808, 767, 416.1, 323.1; 166/75.11, 166/107, 381, 308.1
See application file for complete search history.

(56) References Cited

U.S. PATENT DOCUMENTS

| | | | | |
|---|---|---|---|---|
| 5,035,543 | A | 7/1991 | Medemblik et al. | |
| 5,190,374 | A | 3/1993 | Harms et al. | |
| 6,620,243 | B1 | 9/2003 | Bertellotti et al. | |
| 6,948,535 | B2 | 9/2005 | Stegemoeller | |
| 7,104,328 | B2 | 9/2006 | Phillippi et al. | |
| 7,703,518 | B2 | 4/2010 | Phillippi et al. | |
| 7,926,564 | B2 | 4/2011 | Phillippi et al. | |
| 2010/0000508 | A1* | 1/2010 | Chandler | 126/116 R |
| 2011/0089123 | A1* | 4/2011 | Kennedy et al. | 210/808 |
| 2011/0217129 | A1 | 9/2011 | Fisher et al. | |
| 2012/0128449 | A1* | 5/2012 | Fikes et al. | 414/137.9 |
| 2013/0186510 | A1 | 7/2013 | Stutzman et al. | |
| 2013/0193069 | A1* | 8/2013 | Aiken et al. | 210/615 |
| 2013/0312951 | A1* | 11/2013 | Kellam, III | 166/75.11 |
| 2014/0144641 | A1* | 5/2014 | Chandler | 166/303 |
| 2014/0229120 | A1* | 8/2014 | Luharuka et al. | 702/34 |
| 2014/0238683 | A1* | 8/2014 | Korach et al. | 166/308.1 |
| 2014/0246200 | A1* | 9/2014 | Warren | 166/310 |

* cited by examiner

*Primary Examiner* — Duane Smith
*Assistant Examiner* — Minh-Chau Pham
(74) *Attorney, Agent, or Firm* — Kenneth F. Pearce

(57) ABSTRACT

A proppant dust catcher for a proppant storage device used at a hydraulic fracturing worksite.

20 Claims, 7 Drawing Sheets

DUST COLLECTION SYSTEM

BACKGROUND OF THE INVENTION

1. Field of the Invention

In the most general sense, the present invention relates to a proppant dust catcher for a proppant storage device. The current invention is particularly useful at a hydraulic fracturing worksite. Applicants' invention can reduce the amount of proppant dust escaping from the proppant storage device.

2. Description of the Previous Art

Any discussion of references cited in this Description of the Previous Art merely summarizes the disclosures of the cited references and Applicants make no admission that any cited reference or portion thereof is relevant prior art. Applicants reserve the right to challenge the accuracy, relevancy and veracity of the cited references.

1) U.S. Pat. No. 5,035,543-Medemblik, et al. enables a material transfer apparatus. Columns 3 and 4 of Medemblik, in part, read, "The operation of the conveyor 10 will initially be described generally with reference to FIGS. 1 and 2 of the drawings, FIG. 2 showing a schematic illustrating of the operation of the conveyor 10. A pneumatic device, in the form of a Rootes or positive displacement type blower 16, acts as a vacuum source to draw air into the conveyor 10 through an inlet conduit 18. An operator locates the open end or nozzle (not shown) of the inlet conduit 18 in, for example, a supply of grain and adjusts an air valve (not shown) such that the grain is entrained in a first fluid stream and drawn into the conduit 18. In FIG. 2, the flow of grain is illustrated by the solid arrows 20, while the air flow is represented as the broken arrows 22, the suffixes a and b being used to indicate whether the air and grain is in an area of negative or positive pressure, respectively. The air 22a and entrained grain 20a pass through the conduit 18 into a separation chamber, in the form of a cyclone separator 24. The grain 20a falls to the bottom of the separator 24 where it gathers and is then transported from the separator 24 through a valve means, in the form of an air sealed, rotary valve 26, into an outlet conduit 28. The air 22a leaves the separator 24 through an upper outlet 30 and passes through a conduit 32 leading to the downstream side of the blower 16. The air 22a is drawn through the blower and pushed, through a muffler 34, to a lower portion of the rotary valve 26. The pressurized air stream 22b then pushes the grain 20b from the lower part of the valve 26, the grain 20b becoming entrained in the air stream 22b and carried through the outlet conduit 28, including a retractable boom section, to an elevated material outlet 36 (FIG. 1), normally positioned above an open transport trailor or the like. In this example, the outlet is provided with a cyclone separator, such that the grain leaves the outlet 36 through a downwardly directed opening 37 while the air and particulate matter entrained in the air leaves the outlet through an upwardly directed opening 39.

Among other things, Medemblik does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

2) U.S. Pat. No. 5,190,374-Harms, et al. enables a method and apparatus for continuously mixing well treatment fluids. Column 6 of Harms, in part, reads, "The polymer is introduced into the system by pouring it in bulk form into a hopper portion 14 of a feeder 16. Feeder 16 is preferably of a type which discharges an accurately metered quantity of polymer over time. The feeder illustrated is a metering feeder, such as an Acrison feeder. It should be understood, however, that the invention is not intended to be limited to this particular Acrison feeder. The important feature is that a device be used which provides an accurately metered quantity of polymer discharged therefrom. The Acrison feeder has a large conditioning auger or agitator 18 adjacent to the bottom of hopper 14. Conditioning auger 18 of this prior art feeder "conditions" or stirs the polymer and breaks up any clumps of polymer that might be stuck together. After being stirred by conditioning auger 18, the polymer falls through an opening 20 into a feed chamber 22. A smaller metering auger 23 rotates within chamber 22, and the polymer is discharged from feeder 16 through an outlet 24. In the Acrison feeder, conditioning auger 18 and metering auger 23 rotate at dissimilar speeds. A control box 26 drives conditioning auger 18 and metering auger 23. A speed transducer 28 may be engaged with control box 26."

Among other things, Harms does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

3) U.S. Pat. No. 6,620,243-Bertellotti, et al. enables a fluidized bed powder handling and coating apparatus and methods. The Bertellotti Summary of the Invention, in part, reads, "The present invention provides powder handling and coating apparatus and methods achieving advantages to address the problems mentioned above as well as other powder coating and handling problems. For example, the invention can provide an automated powder coating system which is relatively compact as compared to prior systems. Powder may be conveniently added to supply a closed loop powder handling system of the invention. The system can also automatically mix reclaimed powder and new or so-called virgin powder prior to conveying the mixture into coating structure associated with the system. Also the system eliminates the need for the primary powder filters typically contained in the powder collection loop and therefore eliminates the change in collection vacuum associated with such filters. Also, powder color and/or powder type may be more easily changed due to the elimination of filters in the powder collection loop and the more compact system configuration."

Among other things, Bertellotti does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

4) U.S. Pat. No. 6,948,535-Stegemoeller enables an apparatus and method for accurately metering and conveying dry powder or granular materials to a blender in a substantially closed system. Column 2 of Stegemoeller, in part, reads, "The details of the present invention will now be described with reference to the accompanying drawings. Turning to FIG. 1, an apparatus for accurately metering and conveying a dry powder or granular material 1 in accordance with the present invention is shown generally by reference numeral 10. The apparatus 10 comprises a bulk material tank 12, which is generally cylindrical or rectangular in shape in its upper portion and generally funnel shaped in its lower portion. The bulk material tank 12 is generally a closed container. It has a sealable opening (not shown) for injecting dry powder or granular material into the tank and an outlet for discharging the dry powder or granular material, which is described in more detail below. The bulk material tank 12 is designed to be mobile, i.e., to be transportable to a work site, such as an oil and gas well, for example."

Among other things, Stegemoeller does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

5) U.S. Pat. No. 7,104,328-Phillippi, et al. enables a method and apparatus for hydrating a gel for use in a subterranean well. Column 7 of Phillippi, in part, reads, "FIGS. 3A and B are detail views of a typical centrifugal pump used as mixer 250 with a base fluid inlet 230, leading to inner chamber 220. The impeller 215 has a hub 260 about which a plurality of impeller blades 218 rotate thereby directing fluid flow. Gel powder 245 is introduced into the inner chamber 220 through powder inlet 242. The gel may be a dry powder or a powder which has been prewetted. Although rotation of the impeller creates a mild suction at the powder inlet 242, the powder is fed into the mixer 250 primarily by gravity. The impeller 215 mixes the gel powder 245 and base fluid 235 to form a gel fluid mix 265 or hydrated gel without the formation of unwanted gel balls or clamps. In use, the centrifugal pump 250 establishes a fluid flow through base fluid inlet 230 into the impeller 215 and then out through gel fluid mix outlet 270.

In FIG. 3B, another mixer embodiment is presented. In FIG. 3A, the base fluid inlet 230 housed at least partially by and extends through the hydrated gel outlet 270. In FIG. 3B, the base fluid inlet 230 attaches to the mixer 250 at a location separate from the point of attachment of the hydrated gel outlet 270 to the mixer 250, allowing a larger through-put of base fluid and mixture. FIGS. 3A and B illustrate two possible arrangements for the inlet 230 and outlet 270, but other configurations may be used. The mixer, inlet and outlet size may be chosen to suit the needs of a particular job."

Among other things, Phillippi does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

6) U.S. Pat. No. 7,703,518-Phillippi, et al. enables a dust control system for transferring dry material used in subterranean wells. Columns 4 and 5 of Phillippi, in part, read, "FIGS. 2 and 3 provide two perspective views of an embodiment wherein the cyclone separator 28 and collection container 34 are physically positioned within the supply tank 12. In these figures, parts corresponding to parts shown in FIG. 1 are identified by the same reference numbers. A plate 12' forms a part of the top of the tank 12. The plate 12' also forms the top of the separator 28. The clean air vent 30 extends through the plate 12'. The plate 12' and other portions of cyclone separator 28 may be made of steel. The upper portion of the separator 28 may have a diameter at inlet 26 of about twelve inches and a diameter at solids outlet 32 of about four inches. The collection container 34 may be connected directly to the outlet 32. The lower end of collection container 34 is closed by a butterfly valve 44, which remains closed during transfer of materials into the supply tank 12. A manual crank system 46 is provided for opening the valve 44 from the outside of the tank 12.

In this embodiment, the flow path 38 between collection container 34 and the inlet of pump 36 includes a conduit extending from an outlet 35 in the lower portion of collection container 34 to a fitting 39 on the top of plate 12' and therefore outside tank 12. A second fitting 41 on the top of plate 12' is connected to a short pipe nipple 50 passing through the plate 12' to flow the materials from pump 36 back into the tank 12. The fitting 39 is adapted for connection to the suction inlet of pump 36 and the fitting 41 is adapted for connection to the outlet of pump 36. The pump 36 may therefore be located outside tank 12.

In this embodiment, an inlet 52 is provided in the lower end of collection container 34 about opposite the outlet 35. The inlet 52 is connected by a conduit 54 to a fitting 56 on the upper surface of plate 12'. The fitting 56 is adapted for connection to a source of pressurized air. This air inlet system provides a means for fluidizing any powder which might plug the outlet 35 and interfere with operation of the pump 36.

In operation, the elements shown in FIGS. 2 and 3 are assembled and inserted into an appropriately shaped opening in the top of supply tank 12. The plate 12' is attached to tank 12 by appropriate fasteners and gasket material to prevent any powder from being vented around the plate 12'. Before the mixer 16 of FIG. 1 can be operated, an appropriate amount of dry treating material must be transferred into the supply tank 12 to provide accurate metering of the material into the mixer 16. As the dry treating material is transferred into the supply tank 12, the air used for the pneumatic conveyance flows into the inlet 26 of the cyclone separator 28. As the air spins in the separator 28, the solids are separated and fall through outlet 32 into the collection container 34. Clean air is vented from outlet 30."

Among other things, Phillippi does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

7) U.S. Pat. No. 7,926,564-Phillippi, et al. enables a portable well treating fluid mixing system and method. U.S. Pat. No. 7,926,564-Phillippi, et al. includes disclosure similar to U.S. Pat. No. 7,703,518-Phillippi, et al. Thus, among other things, U.S. Pat. No. 7,926,564 does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

8) US Pub. Patent Application 20110217129-Fisher, et al. discloses pneumatic particulate material fill systems and methods. Paragraphs 31-34 of Fisher read, "Accordingly, the particulate material may be in a powder or granular state when it is fed into the metering feeder 150, and the hopper 145 may be consistently kept full so that a constant volume of material may be drawn by the metering feeder 150. Because the interior environment of the tank 135 is not pressurized, the metering rates of the metering feeder 150 are not affected by an internal pressure of the tank 135. Consequently, the system 100 may be capable of delivering the particulate material out of the tank 135 at a substantially uniform density and rate.

The conveyor 125 may be designed and operated to convey the particulate material to the hopper 145 at a bulk rate that exceeds the maximum rate at which the metering feeder 150 may be capable of transporting the material out of the tank 135. Because the hopper 150 is located above the fill line 155 of the particulate material in the tank, the overflow of the material being delivered to the hopper 150 by the conveyor 125 may spill back into the tank 135. Therefore, the hopper 150 may continuously overfill and spill over during operation of the system. The excess particulate material may then be recycled back to the conveying system while the hopper 150 remains at a consistent material level and density.

FIG. 2 shows a cross-sectional diagram of a particulate material fill and feeder system 200 with a multi-stage cyclone separator feature, in accordance with an exemplary embodiment of the present disclosure. Similar to the system 100, the system 200 may include a cyclone separator 205 having an inlet 210, a first outlet 215 and a second outlet 220, and may be coupled to a conveyor 225. The cyclone separator 205 may receive a pneumatically conveyed stream of particulate material via inlet 210 and may separate solids from the air. Separated solids may drop toward the bottom of separator 205, through the second outlet 220 and toward an inlet 230A of a conveyor 225. An air stream may be vented through the top of the separator 205 via the first outlet 215. The air stream may or may not be clean at the point of discharge through the first outlet 215. For example, the air stream may yet be dust-laden to an undesirable extent, even though a significant amount of solids may have been separated from the air. To further separate solids from the air stream, the air stream may be routed from the first outlet 215 to a secondary cyclone separator 235, which may be coupled to the cyclone separator 205 via connection 240.

The secondary cyclone separator 235 may receive the air stream via an inlet 245 and further separate solids from the air stream. The solids may be directed toward a second outlet 250 near the bottom of the separator 235. The separator 235 may be coupled to the conveyor 225 so that the separated solids may be transferred to the conveyor inlet 230B. The remaining air stream may be vented from the secondary separator 235 via a first outlet 255. Accordingly, a two-stage separator configuration may provide for an additional level of solid separation, thereby capturing more solids and venting cleaner air."

Among other things, Fisher does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

9) US Pub. Patent Application 20130186510-Stutzman, et al. discloses a method of reducing silicosis caused by inhalation of silica-containing proppant, such as silica sand and resin-coated sand, and apparatus therefor. Paragraph 56 of Stutzman reads, "FIG. 6 shows a cross-sectional end view of a portion of the body of a proppant storage device 1 according to at least one embodiment of the application. While the storage device 1 is being filled with proppant, the doors 3, which are shown in FIG. 6 as being closed, may be opened to allow air to vent through outlets 4 and to allow workers to monitor the fill level of proppant in the storage device 1. The exiting air and the feeding of the proppant disturb the proppant, causing the formation of dust clouds which exit via the outlets 4, regardless of whether the doors 3 are closed or opened. To minimize or prevent the spread or exit of these dust clouds, a vacuum suction system may be employed. In operation, a vacuum dust collection machine is connected via an air duct system to collect the dust. In FIG. 6, intake openings 5 are formed in the sides of the outlets 4. A junction duct 15 is located around the intake opening 5 and connects to a side air duct 7. The flow of air through the side air duct 7 can be controlled by a valve 13. The side air ducts 7 lead to a central air duct 9. The central air duct 9 ultimately leads to an exhaust duct 11, which is operatively connected to a dust collector (not shown). The flow of air therefore proceeds as follows: air is drawn in through the outlets 4, then through the intake openings 5, then through the side air ducts 7, then through the central air duct 9, and finally through the exhaust duct 11. The side air ducts 7, the central air duct 9, and the exhaust duct 11 may be located within the frame or body of the storage device 1."

Among other things, Stuzman does not disclose, teach or suggest a proppant storage device with one or more conduits positioned within the internal storage volume of the proppant storage device, where the conduits are connected to one or more vents to an environment external to the proppant storage device and have holes allowing air flow between the internal storage volume and the vents such that when pneumatic energy is supplied to the internal storage volume, the pressure forces air through the holes and one or more filters in proximity with the holes for catching proppant dust prior to entry into the holes.

SUMMARY OF THE INVENTION

The present invention relates to a proppant storage device and proppant dust catcher for the proppant storage device. Proppant storage devices delivering proppant to conveyors that transport the proppant to hydraulic pumps are some of the devices associated with hydraulic fracturing systems capable of extracting crude oil and/or natural gas from subterranean sources. Applicants' inventive combination reduces the amount of proppant dust escaping from the proppant storage device, such as a trailer, at the hydraulic fracturing worksite. In accordance with the current invention, a pneumatic tanker truck or other source of pneumatic energy supplies pressure, proppant or both to the proppant storage device.

An aspect the present invention is to provide a proppant dust catcher for a proppant storage device.

Still another aspect of the present invention is to provide a proppant dust catcher incorporating a filter capable of catching proppant dust while allowing airflow to pass through the filter.

Yet another aspect of the present invention is to provide a proppant dust catcher incorporating a filter of adequate mesh to catch proppant dust.

Still another aspect of the present invention is to provide the combination of a proppant storage device and a proppant dust catcher that utilizes a source of pneumatic energy to catch proppant dust.

It is another aspect of the present invention to provide a proppant storage device including one or more doors that include a seal and a locker.

Still another aspect of the present invention is to provide a proppant dust catcher utilizing conduits with holes for allowing air flow movement between an internal storage volume of the proppant storage device and the conduits.

Yet another aspect of the present invention is to provide a proppant dust catcher having conduits that can include a generally round, a generally square or a generally rectangular cross-section.

An embodiment of the present invention can be described as a proppant storage device for use with a hydraulic fracturing system; the proppant storage device comprising a proppant dust catcher at least partially enclosed by the proppant storage device: I) the proppant storage device further comprising: a) a bed capable of directing proppant away from the proppant storage device; b) a plurality of outer generally vertical walls; c) a roof comprising one or more doors, wherein a combination of the bed, the outer generally vertical walls and the roof create a holding chamber for proppant; d) one or more inner vertical walls subdividing the holding chamber into sections; and e) a connection with a source of pneumatic energy supplying the proppant and pressure to the holding chamber; and II) the proppant dust catcher comprising: a) a plurality of conduits positioned proximate an inward side of the roof and connected with ports to an environment external to the proppant dust catcher; each conduit spanning above the proppant contained in each section and comprising holes allowing air flow between the holding chamber and the conduits moving air flow between the holding chamber and the environment external to the proppant dust catcher, wherein when the pneumatic energy is supplied to the holding chamber, the pressure forces air through the holes; and b) a filter proximate each of the conduits including the holes, wherein the filter is positioned between the holes and the sections for catching proppant dust prior to entry into said holes.

Another embodiment of the present invention can be described as a combination of a proppant dust catcher and a proppant storage device for a hydraulic fracturing system; the proppant storage device comprising a bed capable of directing proppant away from the proppant storage device, at least one generally vertical containing wall comprising one or more ports therein, a roof comprising one or more doors and a connection with a source of pneumatic energy supplying the proppant and pressure to said holding chamber, wherein the bed, at least one generally vertical containing wall and the roof enclose a containment volume of the proppant storage device, and wherein the proppant dust catcher is partially enclosed by the containment volume: the proppant dust catcher comprising: a) a plurality of conduits positioned within the containment volume, wherein one or more of the conduits comprises holes allowing air flow between the containment volume and one or more conduits capable of moving air flow between the containment volume and one or more ports allowing air flow between one or more conduits and an environment external to the proppant storage device; and wherein, when said pneumatic energy is supplied to the containment volume the pressure forces air through the holes; and b) a filter proximate each of the conduits including the holes, wherein the filter is positioned between the holes and the containment volume for catching proppant dust prior to entry into said holes.

Still another embodiment of the present invention can be described as a method of supplying a proppant dust catcher to a proppant storage trailer; the method comprising the steps of: a) creating an entrance in a wall or a roof of the proppant storage trailer for installing the proppant dust catcher and sealing the entrance subsequent to installation of the proppant dust catcher; b) if internal vertical walls are provided with the proppant storage trailer, making apertures through the internal vertical walls associated with the proppant storage trailer when the internal vertical walls do not already have the apertures; c) providing one or more conduits comprising holes and coupling ends; d) fitting one or more conduits through the apertures and positioning the conduits superior to proppant stored in the proppant storage trailer; e) creating one or more ports in an outer wall of the proppant storage trailer and associating the coupling ends with one or more ports such that air can flow between the conduits and an environment external to the proppant storage trailer; f) affixing one or more filters proximate the holes, wherein the filters are of adequate mesh to catch proppant dust while allowing air flow to travel through one or more conduits; and g) providing a source of pneumatic pressure to the proppant storage trailer, wherein the pneumatic pressure can assist movement of proppant into the proppant storage trailer and force the proppant dust toward one or more filters.

Yet another embodiment of the present invention can be described as a combination of a proppant dust catcher and a proppant storage device for use with a hydraulic fracturing system: I) the proppant storage device comprising: a) an internal storage volume; b) a connection with a source of pneumatic energy supplying pressure to the proppant storage device; the pneumatic energy capable of assisting movement of proppant about the proppant storage device; and c) at least one port allowing air flow to and from an environment external to the proppant storage device; and II) the proppant dust catcher comprising: a) at least one conduit positioned within the internal storage volume coupled at first end to the port; the conduit comprising a plurality of holes allowing air flow between the internal storage volume and the conduit, wherein the conduit can move air flow between the internal storage volume and the port, and wherein, when the pneumatic energy is supplied to the internal storage volume, the pressure forces air through the holes; and b) one or more filters in proximity with the holes for catching proppant dust prior to entry into the holes from the internal storage volume.

Another embodiment of the present invention can be described as a proppant dust catcher for a containment volume of a proppant storage device, wherein the containment volume can be supplied with proppant and pneumatic energy from a source distinct from the proppant storage device; the proppant dust catcher comprising: a) a plurality of conduits communicating with one or more ports allowing air flow to and from an environment external of the containment volume, wherein one or more of the conduits comprises holes allowing air flow between the containment volume and one or more ports; and b) a filter proximate each of the conduits including the holes, wherein the filter is positioned between the holes the said containment volume for catching proppant dust prior to entry into the holes.

It is the novel and unique interaction of these simple elements which creates the methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

Although the disclosure hereof is detailed to enable those skilled in the art to practice the invention, the embodiments published herein merely exemplify the present invention.

Figure 1:
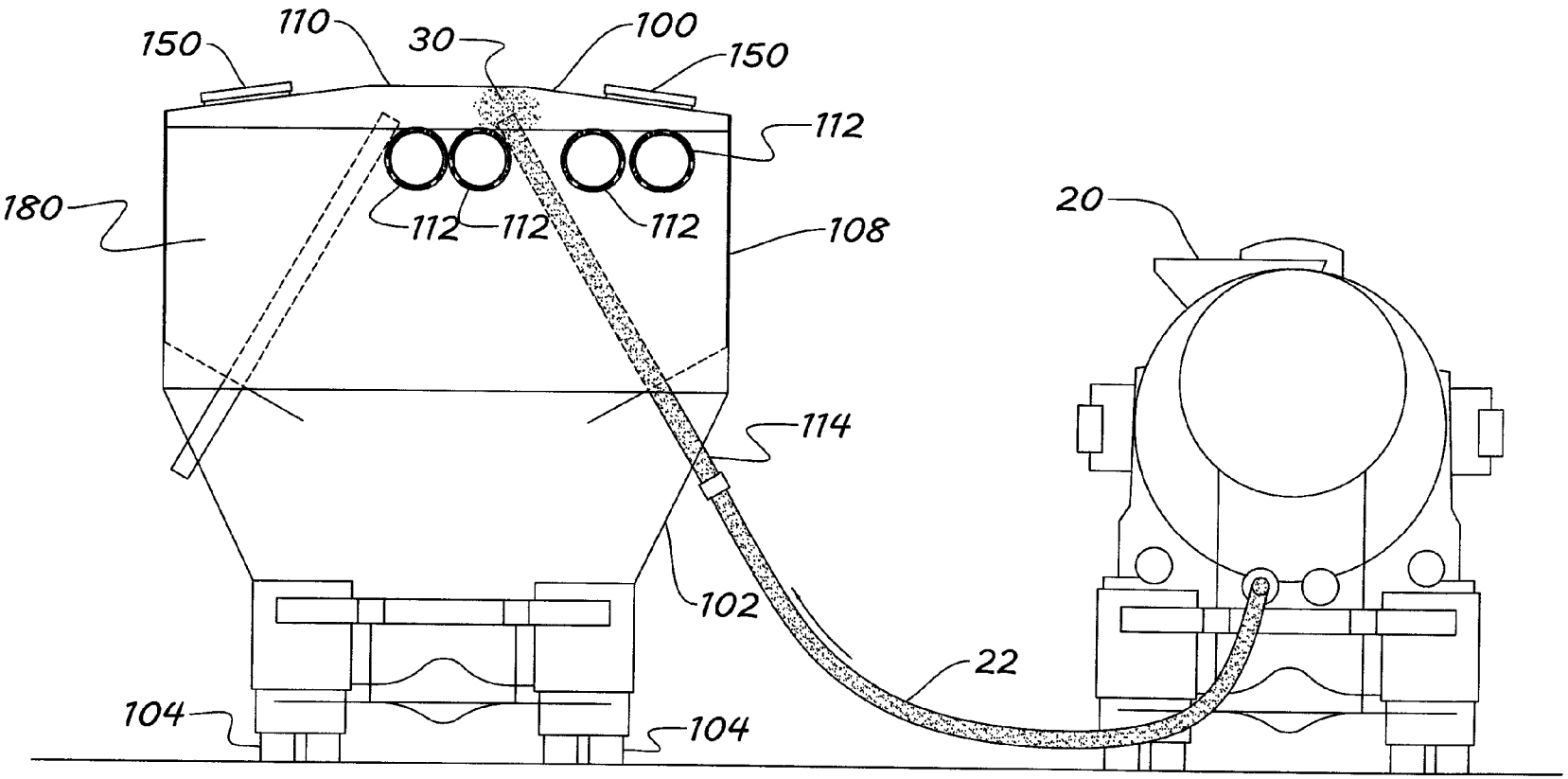
FIG. 1 is a perspective showing a relationship between a source of pneumatic energy that supplies proppant and pressure and a proppant storage device.

FIG. 1 is a perspective showing a relationship between a source of pneumatic energy that supplies proppant and pressure (20), such as pneumatic a tanker truck carrying proppant (30), and a proppant storage device (100), such as a mobile proppant storage trailer. Those skilled in the art recognize that the source of pneumatic energy supplying proppant and pressure (20) and the proppant storage device (100) are components of a hydraulic fracturing system capable of extracting crude oil and/or natural gas from underground sources. Within the scope of the current invention, proppant (30) is generally composed of silica or sand.

As shown in FIG. 1, proppant storage device (100) is provided with wheels (104), bed (102), at least one generally vertical wall (108), roof (110), doors (150), ports (112) and a connection or fill pipe (114) with tube (22) that is attached to tanker truck (20). Bed (104) is capable of directing proppant (30) from proppant storage device (100) and toward the hydraulic pump (not shown) of the hydraulic fracturing system. The combination of bed (104), one or more generally vertical walls (108) and roof (110) create a holding chamber, containment volume or internal storage volume (180) for temporarily holding proppant (30). Through tube (22), tanker truck (20) is capable of pumping proppant (30) and pneumatic pressure into holding chamber (180) of proppant storage trailer (100). Although not shown in FIG. 1, select preferred embodiments of proppant storage (100) utilize a single vertical wall (108).

Figure 3:
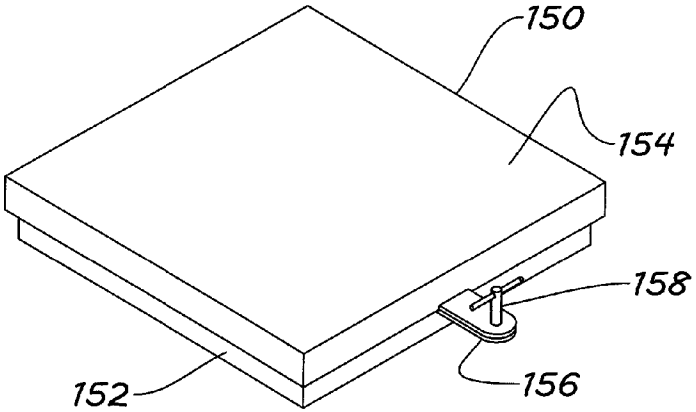
FIG. 3 is an illustrative view of a preferred embodiment of a door within the scope of the current invention.
Figure 2:
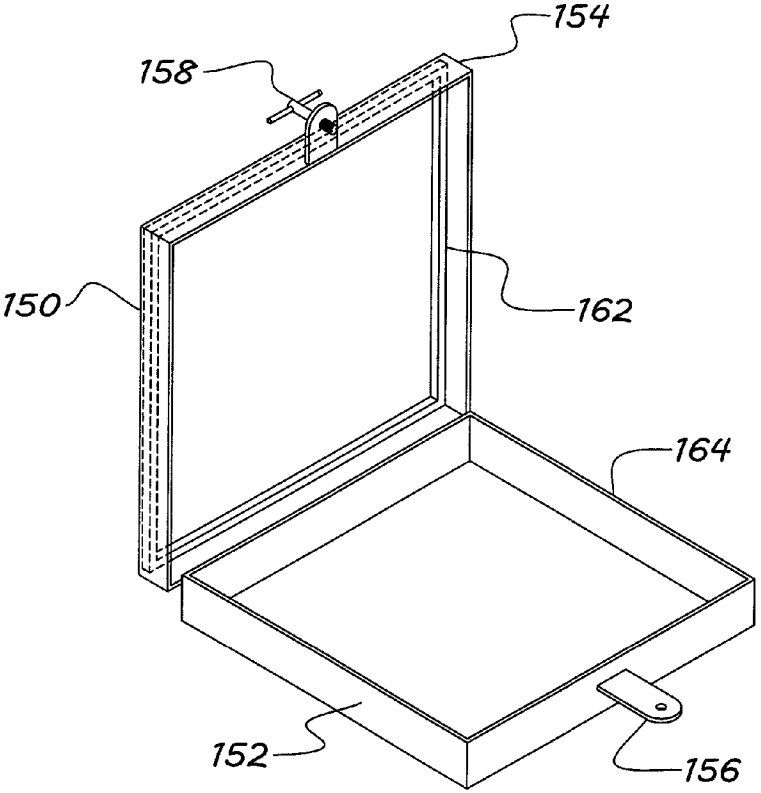
FIG. 2 is an illustrative view of a preferred embodiment of a door within the scope of the current invention.

FIG. 2 is an illustrative view of a preferred embodiment of a door (150) within the scope of the current invention. In accordance with the current invention, operators can open door (150) of proppant storage device (100) to view inside containment volume or internal storage volume (180) of proppant storage device. As shown, door (150) is provided with frame (152), lid (154), receiving tab (156), locker (158), such as a T-handle bolt, and seal (162), such as a gasket. Frame (152) is attached to proppant storage device (100) in any manner acceptable in the art. As illustrated in FIGS. 2 and 3, when lid (154) is closed, seal (162) contacts superior side (164) of frame (152)—the combination of seal (162), superior side (164), locker (158) and receiving tab (156) creates a seal that lessens the escape of pneumatic pressure through doors (150) of proppant storage trailer (100).

Figure 4:
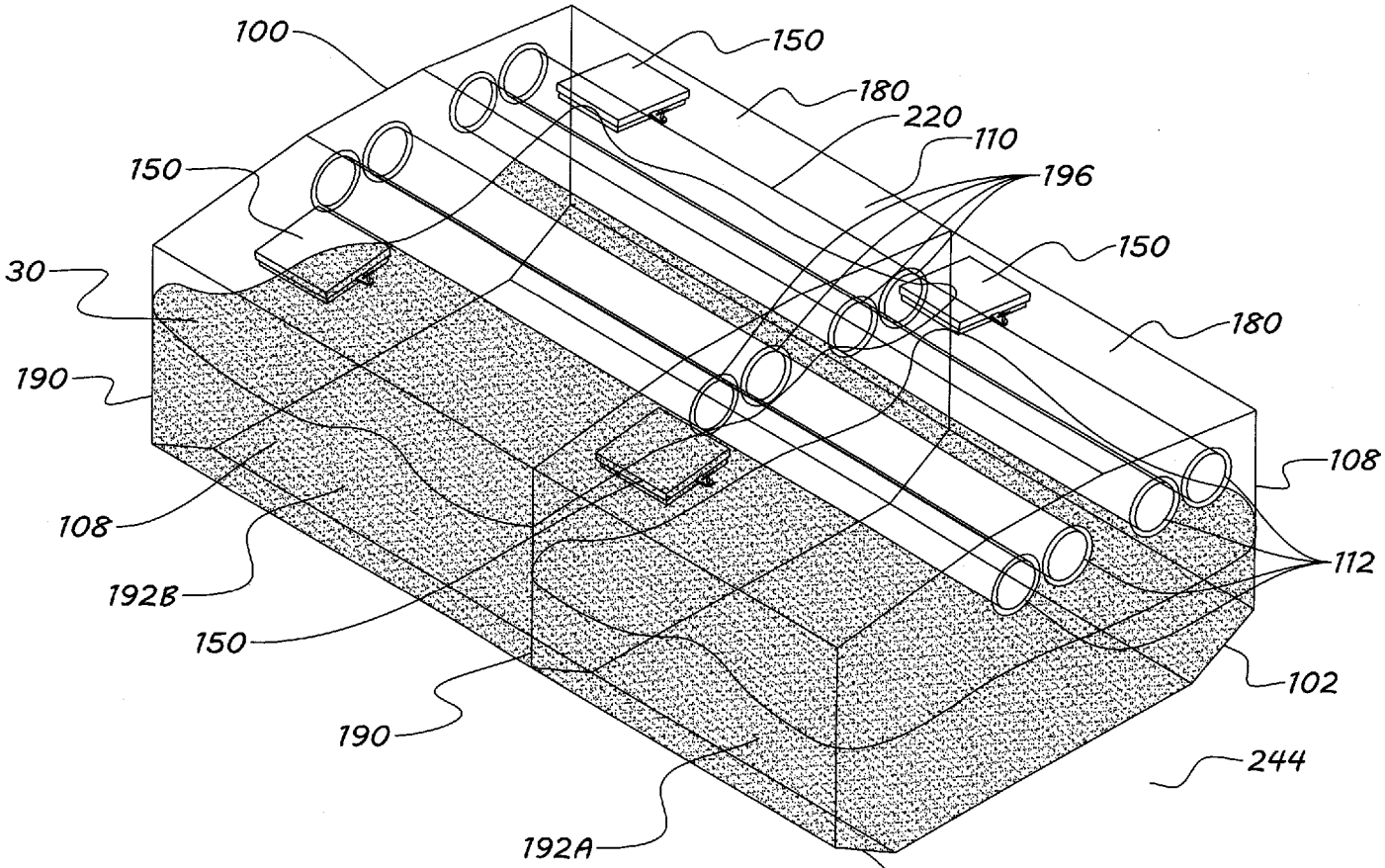
FIG. 4 is a perspective view of a preferred embodiment of proppant storage device within the scope of the present invention.

FIG. 4 is a perspective view of a preferred embodiment of proppant storage device (100) having bed (102), a plurality of vertical walls (108), roof (110) and inner vertical walls (190) subdividing the holding chamber (180) into sections (192A, 194B, etc.). Inner vertical walls (190) are provided with apertures (196) for receiving one or more conduits (220) positioned superior to proppant (30) contained within the internal storage volume (180) of proppant storage device (100). Conduits (220) span superior to proppant (30) and are connected to ports (112) to vent into environment (244) external to proppant storage device (100

Figure 5:
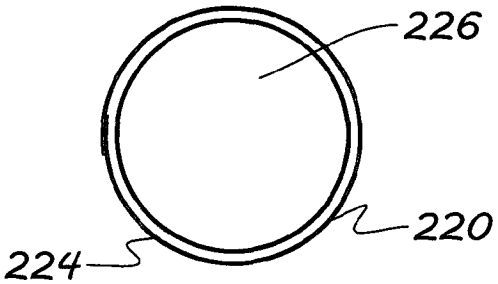
FIG. 5 is a frontal perspective of a preferred embodiment of conduit within the ambit of the current invention.
Figure 6:
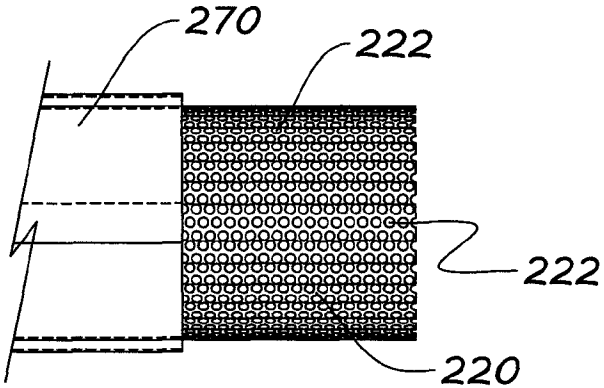
FIG. 6 is a lateral perspective of the conduit shown in FIG. 5.

FIG. 5 is a frontal perspective of a preferred embodiment of conduit (220) where gap (226) of conduit (220) allows direct air flow between conduit (220) and port (112). As shown in FIG. 5, conduit (220) has exterior (224) surrounding gap (226), where exterior (224) is of generally tubular construction. FIG. 6 is a lateral perspective of conduit (220) shown in FIG. 5 with a portion of filter (270) cut away. As shown in FIG. 6, exterior (224) of conduit (220) is provided with a plurality of holes (222). In operation of the current invention, filter (270) is positioned proximate holes (222) while in select preferred embodiments, filter (270) can contact conduit (220).

Figure 7:
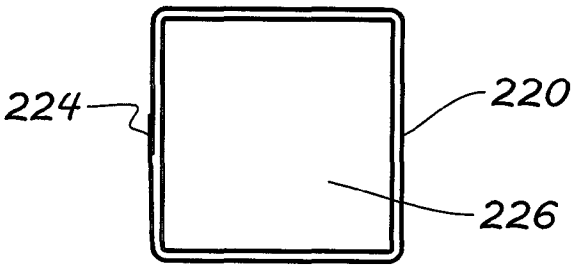
FIG. 7 is a frontal perspective of a preferred embodiment of conduit within the ambit of the current invention.
Figure 8:
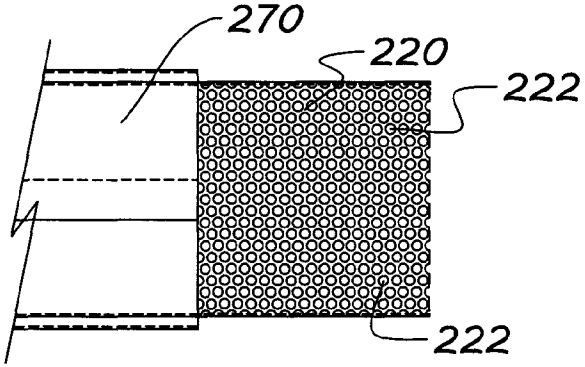
FIG. 8 is a lateral perspective of the conduit shown in FIG. 7.

FIG. 7 is a frontal perspective of a preferred embodiment of conduit (220) where gap (226) of conduit (220) allows air flow between conduit (220) and port (112). As shown in FIG. 7, conduit (220) has exterior (224) surrounding gap (226), where exterior (224) is of generally square or rectangular construction. FIG. 8 is a lateral perspective of conduit (220) shown in FIG. 7 with a portion of filter (270) cut away. As shown in FIG. 8, conduit (220) is provided with a plurality of holes (222). In operation of the current invention, filter (270) is positioned proximate holes (222) while in select preferred embodiments, filter (270) can contact conduit (220). Depending on engineering parameters, within the ambit of the current invention, conduits (220) or ductwork can be manufactured in shapes other than generally round, square or rectangular. Further, within the scope of the current invention, holes (222) are of such dimension to prevent proppant or sand (30) from passing through holes (222).

Figure 9:
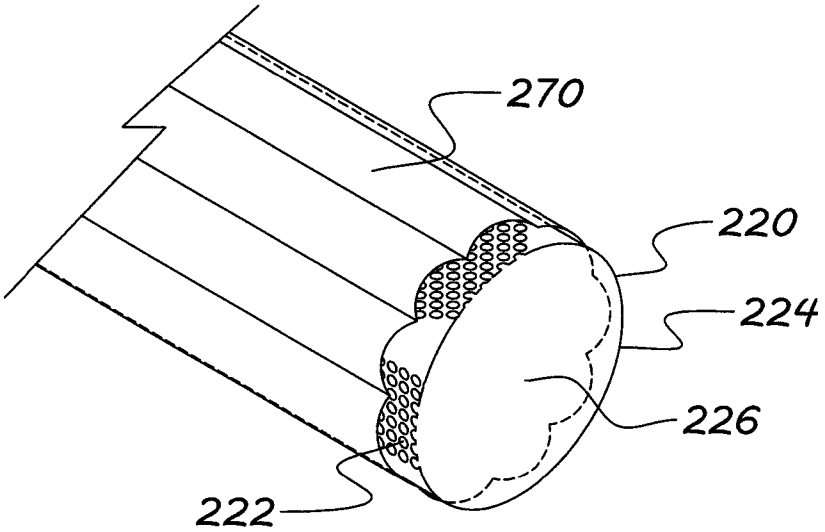
FIG. 9 is a lateral perspective of a conduit and filter within the scope of the current invention.

FIG. 9 is a lateral perspective of a conduit (220) and filter (270) within the scope of the current invention. In select preferred embodiments, one or more filters (270) are positioned proximate holes (222) and exterior (224) of conduit (220). Filters (270) of the current invention are of adequate mesh to catch proppant dust while allowing air flow to travel through conduits (220). Examples of compositions for filters of the current invention include but are not limited to polyester or polypropylene felt, cotton or polyester sateen, nylon mesh or cotton flannel. Select preferred embodiments of the present invention utilizel2 ounce singed polyester felt.

In accordance with the present invention, in select preferred embodiments, the combination of ports (112), one or more conduits (220) and one or more filters (270) create the current proppant dust catcher associated with internal storage volume (180) of proppant storage device (100). In a preferred embodiment of the current proppant dust catcher, a source of pneumatic energy (20) supplies proppant and pressure to proppant storage device (100). Among other things, the pneumatic energy forces proppant dust within containment chamber (180) toward one or more filters (270) proximate or contacting one or more conduits (220) positioned within internal storage volume (180) of proppant storage device (100). In select preferred embodiments, one or more conduits (220) span at least part of containment volume (180) of proppant storage device (20) such that conduits (220) are positioned superior to proppant (30) carried by bed (104) of proppant storage device (100). When the source of pneumatic energy (20) is supplying pressure to proppant storage device (100), air from containment volume (180) is forced through one or more filters (270) into conduits (220) that transport filtered air to ports (112). Through ports (112), the transported filtered air exits into an environment (244) external to proppant storage device (100). One or more filters (270) of the current proppant dust catcher retain a majority of proppant dust within the containment volume (180) of proppant storage device (100). Through experimentation, dependent on the composition of the filter proximate the conduit, as much as 95% of the proppant dust can be retained in containment volume (180) of proppant storage device (180).

Figure 10:
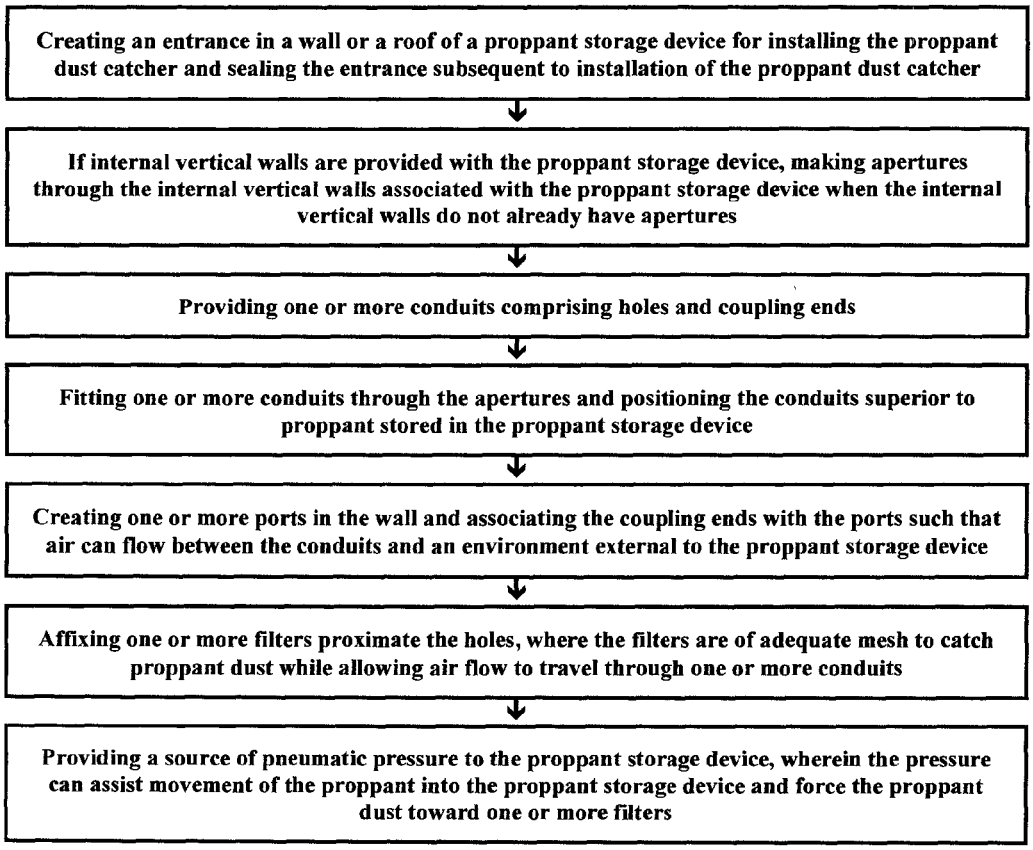
FIG. 10 illustrates the steps associated with the practice of a preferred embodiment the current dust collection system.
Figure 11:
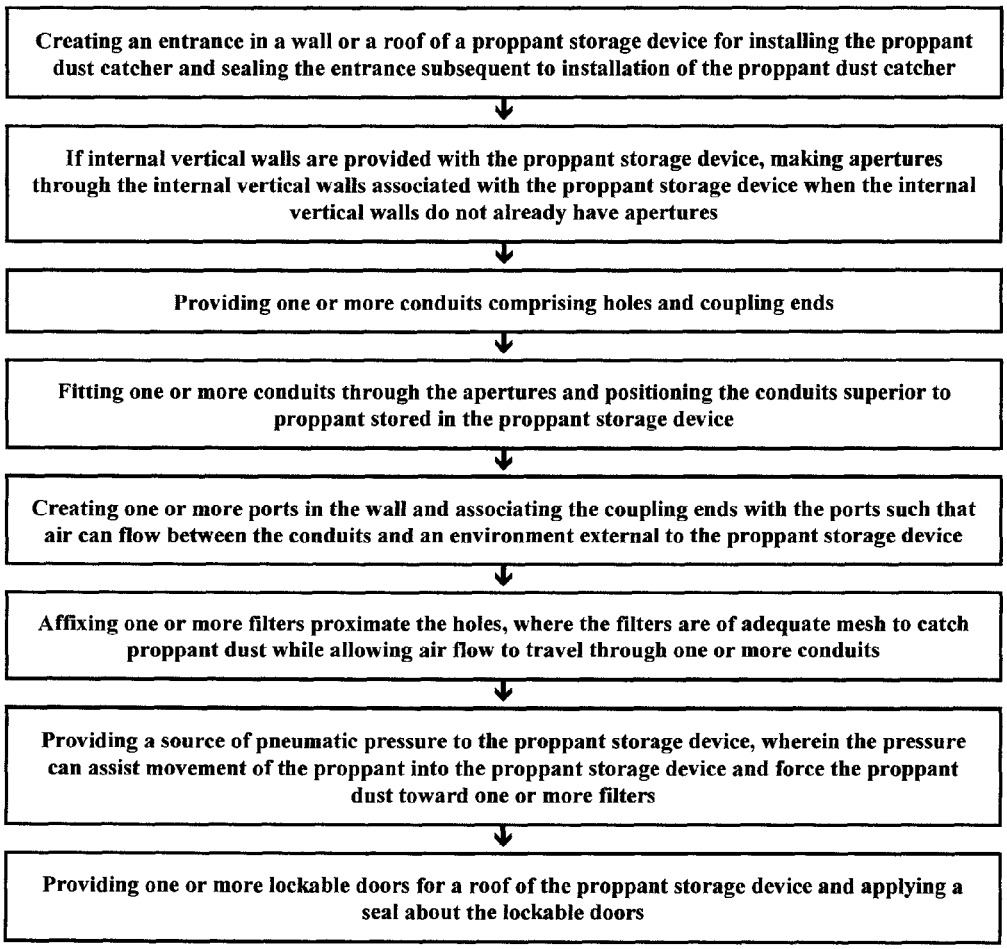
FIG. 11 illustrates the steps associated with the practice of another preferred embodiment the current dust collection system.

Select steps associated with the practice of methods associated with Applicants' dust collection system are depicted in FIGS. 10 and 11.

Having disclosed the invention as required by Title 35 of the United States Code, Applicants now pray respectfully that Letters Patent be granted for their invention in accordance with the scope of the claims appended hereto.

What is claimed is:

1. A proppant storage device for use with a hydraulic fracturing system; said proppant storage device comprising a proppant dust catcher at least partially enclosed by said proppant storage device:

I) said proppant storage device further comprising:

a) a bed capable of directing proppant away from said proppant storage device;

b) a plurality of outer generally vertical walls;

c) a roof comprising one or more doors, wherein a combination of said bed, said outer generally vertical walls and said roof create a holding chamber for proppant;

d) one or more inner vertical walls subdividing said holding chamber into sections; and e) a connection with a source of pneumatic energy supplying proppant and pressure to said holding chamber; and II) said proppant dust catcher comprising:

a) a plurality of conduits positioned proximate an inward side of said roof and connected with ports to an environment external to said proppant dust catcher; each said conduit spanning above said proppant contained in each said section and comprising holes allowing air flow between said holding chamber and said conduits moving air flow between said holding chamber and said environment external to said proppant dust catcher, wherein when said pneumatic energy is supplied to said holding chamber, said pressure forces air through said holes; and b) a filter proximate each of said conduits including said holes, wherein said filter is positioned between said holes and said sections for catching proppant dust prior to entry into said holes.

2. The proppant dust catcher of claim 1, wherein said doors further comprise:

a) a seal; and b) a locker.

3. The proppant dust catcher of claim 2, wherein said filter comprises polyester felt, polypropylene felt, cotton sateen, polyester sateen, nylon mesh, cotton flannel or combinations thereof.

4. A combination of a proppant dust catcher and a proppant storage device for a hydraulic fracturing system:

I) said proppant storage device comprising a bed capable of directing proppant away from said proppant storage device, at least one generally vertical containing wall comprising one or more ports therein, a roof comprising one or more doors and a connection with a source of pneumatic energy supplying said proppant and pressure to said holding chamber, wherein said bed, said at least one generally vertical containing wall and said roof enclose a containment volume of said proppant storage device, and wherein said proppant dust catcher is partially enclosed by said containment volume; and said proppant dust catcher comprising:

a) a plurality of conduits positioned within said containment volume, wherein one or more of said conduits comprises holes allowing air flow between said containment volume and said one or more conduits capable of moving air flow between said containment volume and said one or more ports allowing air flow between said one or more conduits and an environment external to said proppant storage device; and wherein, when said pneumatic energy is supplied to said containment volume said pressure forces air through said holes; and b) a filter proximate each of said conduits including said holes, wherein said filter is positioned between said holes and said containment volume for catching proppant dust prior to entry into said holes.

5. The proppant storage device of claim 4, wherein said doors further comprise:

a) a seal; and b) a locker.

6. The proppant storage device of claim 5 comprising at least four generally vertical containing walls.

7. The proppant dust catcher for said proppant storage device of claim 6, wherein each of said plurality of conduits comprises a generally round, a generally square or a generally rectangular cross-section.

8. The proppant storage device of claim 7 comprising one or more inner vertical walls subdividing said containment volume into sections, wherein said inner vertical walls comprise apertures for receiving said plurality of conduits.

9. The proppant dust catcher of claim 8, wherein said filter comprises polyester felt, polypropylene felt, cotton sateen, polyester sateen, nylon mesh, cotton flannel or combinations thereof.

10. A method of supplying a proppant dust catcher to a proppant storage trailer; said method comprising the steps of:

a) creating an entrance in a wall or a roof of said proppant storage trailer for installing said proppant dust catcher and sealing said entrance subsequent to installation of said proppant dust catcher;

b) if internal vertical walls are provided with said proppant storage trailer, making apertures through said internal vertical walls associated with said proppant storage trailer when said internal vertical walls do not already have said apertures;

c) providing one or more conduits comprising holes and coupling ends;

d) fitting said one or more conduits through said apertures when said proppant storage trailer is provided with said internal vertical walls e) positioning said conduits superior to proppant stored in said proppant storage trailer;

f) creating one or more ports in an outer wall of said proppant storage trailer and connecting said coupling ends with said one or more ports such that air can flow between said conduits and an environment external to said proppant storage trailer;

g) affixing one or more filters proximate said holes, wherein said filters are of adequate mesh to catch proppant dust while allowing air flow to travel through said one or more conduits; and h) providing a source of pneumatic pressure to said proppant storage trailer, wherein said pneumatic pressure can assist movement of proppant into said proppant storage trailer and force said proppant dust toward said one or more filters.

11. The method of claim 10 comprising the steps of:

a) providing one or more lockable doors for a roof of said proppant storage trailer; and b) applying a seal about said lockable doors.

12. A combination of a proppant dust catcher and a proppant storage device for use with a hydraulic fracturing system:

I) said proppant storage device comprising:

a) an internal storage volume; and b) a connection with a source of pneumatic energy supplying pressure to said proppant storage device; said pneumatic energy capable of assisting movement of proppant about said proppant storage device; and c) at least one port allowing air flow to and from an environment external to said proppant storage device; and II) said proppant dust catcher comprising:

a) at least one conduit positioned within said internal storage volume coupled at first end to said port; said conduit comprising a plurality of holes allowing air flow between said internal storage volume and said conduit, wherein said conduit can move air flow between said internal storage volume and said port, and wherein, when said pneumatic energy is supplied to said internal storage volume, said pressure forces air through said holes and said at least one port to an environment external of said proppant storage device; and b) one or more filters in proximity with said holes for catching proppant dust prior to entry into said holes from said internal storage volume.

13. The proppant storage device of claim 12 comprising:

a) a bed capable of directing proppant away from said proppant storage device; and b) at least one generally vertical containing wall.

14. The proppant storage device of claim 13 further comprising a roof comprising and at least one door, wherein said door comprises:

a) a seal; and b) a locker.

15. The proppant dust catcher of claim 14, wherein each said filter is of adequate mesh to catch proppant dust while allowing air flow to travel through said holes.

16. The proppant dust catcher of claim 15, wherein each of said plurality of conduits comprises a generally round, a generally square or a generally rectangular cross-section.

17. The proppant dust catcher of claim 16, wherein said filter comprises polyester felt, polypropylene felt, cotton sateen, polyester sateen, nylon mesh, cotton flannel or combinations thereof.

18. A proppant dust catcher for a containment volume of a proppant storage device, said containment volume containing proppant supplied by a source distinct from said proppant storage device; said proppant dust catcher comprising:

a) a plurality of conduits connected with one or more ports of said proppant storage device allowing air flow to and from an environment external of said containment volume, wherein one or more of said conduits comprises holes allowing air flow between said containment volume and said one or more ports; and b) a filter proximate each of said conduits including said holes, wherein said filter is positioned between said holes and said containment volume for catching proppant dust prior to entry into said holes.

19. The proppant dust catcher of claim 17, wherein said filter comprises polyester felt, polypropylene felt, cotton sateen, polyester sateen, nylon mesh, cotton flannel or combinations thereof.

20. The proppant dust catcher of claim 19, wherein each of said plurality of conduits comprises a generally round, a generally square or a generally rectangular cross-section.

* * * * *

UNITED STATES PATENT AND TRADEMARK OFFICE

CERTIFICATE OF CORRECTION

PATENT NO. : 9,115,557 B1
APPLICATION NO. : 14/094874
DATED : August 25, 2015
INVENTOR(S) : Ronald Ortowski and Patrick McGuire It is certified that error appears in the above-identified patent and that said Letters Patent is hereby corrected as shown below:

In the Claims

Column 12, lines 16-44 Claim 4 should read:

-- A combination of a proppant dust catcher and a proppant storage device for a hydraulic fracturing system:

I) said proppant storage device comprising a bed capable of directing proppant away from said proppant storage device, at least one generally vertical containing wall comprising one or more ports therein, a roof comprising one or more doors and a connection with a source of pneumatic energy supplying said proppant and pressure to said holding chamber, wherein said bed, said at least one generally vertical containing wall and said roof enclose a containment volume of said proppant storage device, and wherein said proppant dust catcher is partially enclosed by said containment volume; and II) said proppant dust catcher comprising:

a) a plurality of conduits positioned within said containment volume, wherein one or more of said conduits comprises holes allowing air flow between said containment volume and said one or more conduits capable of moving air flow between said containment volume and said one or more ports allowing air flow between said one or more conduits and an environment external to said proppant storage device; and wherein, when said pneumatic energy is supplied to said containment volume said pressure forces air through said holes; and b) a filter proximate each of said conduits including said holes, wherein said filter is positioned between said holes and said containment volume for catching proppant dust prior to entry into said holes. --

Signed and Sealed this
Twenty-seventh Day of October, 2015

Michelle K. Lee

Michelle K. Lee
*Director of the United States Patent and Trademark Office*